US007217110B2

(12) United States Patent
Dreiman

(10) Patent No.: US 7,217,110 B2
(45) Date of Patent: May 15, 2007

(54) COMPACT ROTARY COMPRESSOR WITH CARBON DIOXIDE AS WORKING FLUID

(75) Inventor: Nelik I. Dreiman, Tipton, MI (US)

(73) Assignee: Tecumseh Products Company, Tecumseh, MI (US)

( * ) Notice: Subject to any disclaimer, the term of this patent is extended or adjusted under 35 U.S.C. 154(b) by 298 days.

(21) Appl. No.: 10/796,711

(22) Filed: Mar. 9, 2004

(65) Prior Publication Data

US 2005/0201884 A1 Sep. 15, 2005

(51) Int. Cl.
*F03C 2/00* (2006.01)
*F04C 18/00* (2006.01)

(52) U.S. Cl. ..... 418/173; 418/94; 418/177; 417/356

(58) Field of Classification Search ..... 418/94, 418/173, 177; 417/357, 356, 410.3, 357.4; 184/6.16, 6.18
See application file for complete search history.

(56) References Cited

U.S. PATENT DOCUMENTS

| | | | | | |
|---|---|---|---|---|---|
| 1,882,220 | A | * | 10/1932 | Kercher | 417/284 |
| 1,964,415 | A | | 6/1934 | Van Deventer | |
| 2,122,462 | A | | 7/1938 | Fricke | |
| 2,143,399 | A | | 1/1939 | Abercrombie | |
| 2,324,434 | A | * | 7/1943 | Shore | 417/356 |
| 2,415,011 | A | * | 1/1947 | Hubacker | 417/256 |
| 2,420,124 | A | | 5/1947 | Coulson | |
| 2,440,593 | A | * | 4/1948 | Miller | 418/173 |
| 2,898,032 | A | * | 8/1959 | Katzenberger | 417/356 |
| 3,592,176 | A | | 7/1971 | Fenne | |
| 3,697,203 | A | | 10/1972 | Butler | |
| 3,845,784 | A | | 11/1974 | Sullivan | |
| 4,172,465 | A | | 10/1979 | Dashner | |
| 4,384,828 | A | | 5/1983 | Rembold et al. | |
| 4,427,351 | A | | 1/1984 | Sano | |
| 4,673,343 | A | | 6/1987 | Moore | |
| 4,773,836 | A | | 9/1988 | Moore | |
| 4,892,467 | A | | 1/1990 | Crofoot | |
| 4,900,237 | A | | 2/1990 | Reedy | |
| 4,958,991 | A | | 9/1990 | Kikuchi | |
| 5,035,587 | A | | 7/1991 | Collingborn | |
| 5,181,843 | A | | 1/1993 | Hekman et al. | |
| 5,577,903 | A | | 11/1996 | Yamamoto | |
| 5,580,231 | A | | 12/1996 | Yasui | |
| 5,641,279 | A | | 6/1997 | Yamamoto | |

(Continued)

FOREIGN PATENT DOCUMENTS

| | | | | |
|---|---|---|---|---|
| JP | 01253583 A | * | 10/1989 | 418/177 |

*Primary Examiner*—Theresa Trieu
(74) *Attorney, Agent, or Firm*—Baker & Daniels LLP

(57) ABSTRACT

A rotary compressor for compressing a working fluid includes a housing having an oil sump. A stationary shaft extends into the housing and includes a longitudinal passage. The longitudinal passage has an oil inlet in fluid communication with the oil sump. A working fluid inlet receives the working fluid. A motor has a stator and a rotor. The rotor is rotatably mounted on the shaft within the housing and includes an internal compression chamber in fluid communication with the longitudinal passage. A roller is rotatably mounted on the shaft and eccentrically disposed within the compression chamber. The roller is coupled to the rotor such that rotation of the rotor rotates the roller and thereby compresses the working fluid within the compression chamber.

35 Claims, 6 Drawing Sheets

U.S. PATENT DOCUMENTS

| | | | |
|---|---|---|---|
| 5,733,112 | A | 3/1998 | Kang |
| 6,024,548 | A | 2/2000 | Bushnell |
| 6,068,022 | A | 5/2000 | Schultz et al. |
| 6,077,058 | A | 6/2000 | Saitou et al. |
| 6,152,718 | A | 11/2000 | Kobayashi |
| 6,234,194 | B1 | 5/2001 | Jainek et al. |
| 6,585,498 | B2 | 7/2003 | Arbogast et al. |
| 6,616,428 | B2 | 9/2003 | Ebara et al. |
| 6,769,267 | B2 | 8/2004 | Ebara et al. |
| 2003/0115900 | A1 | 6/2003 | Matsumoto et al. |
| 2005/0201884 | A1 | 9/2005 | Dreiman |

* cited by examiner

COMPACT ROTARY COMPRESSOR WITH CARBON DIOXIDE AS WORKING FLUID

BACKGROUND OF THE INVENTION

1. Field of the Invention

The present invention relates to a rotary compressor having a compact design wherein the compression chamber is defined by the rotor of the motor driving the compressor.

2. Description of the Related Art

Rotary compressors typically include a housing in which a motor and a compression mechanism are mounted on a drive shaft. Rotary type compression mechanisms typically include a roller disposed about an eccentric portion of the shaft. The roller is located in a cylinder block that defines a cylindrical compression space or chamber. At least one vane extends between the roller and the outer wall of the compression chamber to divide the compression chamber into a suction pocket and a compression pocket. The roller is eccentrically located within the compression chamber. As the shaft rotates, the suction pocket becomes progressively larger, thereby drawing a refrigerant or other fluid into the suction pocket. Also as the shaft rotates, the compression pocket becomes progressively smaller, thereby compressing the fluid disposed therein. Oftentimes the vane is biased into contact with either the wall of the compression chamber or the roller by a spring. Other configurations of rotary compressors are also known.

SUMMARY OF THE INVENTION

The present invention provides a compact rotary compressor where the compression chamber is located within the rotor and the roller is mounted on a stationary shaft and wherein the shaft has a longitudinal passage defining the refrigerant inlet and an oil passage that is in communication both with the refrigerant inlet passage in the shaft and an oil sump contained within the compressor housing. The interior of the compressor housing is at discharge pressure whereby oil from the sump enters the oil passage in the shaft and flows upwardly through the stationary shaft due to the pressure differential within the stationary shaft. At least a portion of the oil exits the stationary shaft through the same radial passage as does the refrigerant.

The present invention comprises, in one form thereof, a rotary compressor for compressing a working fluid including a housing having an oil sump. A stationary shaft extends into the housing and includes a longitudinal passage. The longitudinal passage has an oil inlet in fluid communication with the oil sump. A working fluid inlet receives the working fluid. A motor has a stator and a rotor. The rotor is rotatably mounted on the shaft within the housing and includes an internal compression chamber in fluid communication with the longitudinal passage. A roller is rotatably mounted on the shaft and eccentrically disposed within the compression chamber. The roller is coupled to the rotor such that rotation of rotor compresses the working fluid within the compression chamber.

The housing may include an interior chamber in which the oil sump is disposed. The motor may increase a pressure within the interior chamber to thereby cause oil from the oil sump to enter the oil inlet and flow within the longitudinal passage in a substantially upward direction.

The shaft may include at least one substantially radially-oriented passage providing fluid communication between the longitudinal passage and the compression chamber. At least a portion of the oil and at least a portion of the working fluid may exit the longitudinal passage through a same one of the radially-oriented passages.

The compressor may also include a bearing disposed between the shaft and the roller. The radially-oriented passage may allow the oil from the longitudinal passage to reach the bearing.

The housing may include an outlet to allow compressed working fluid to exit the interior chamber. The roller may include a channel providing fluid communication between the longitudinal passage and the compression chamber.

The rotor may be a non-laminated integrally formed part and may include a radially outer surface having a plurality of magnets mounted therein. The rotor may also include a vane extending radially inwardly within the compression chamber and coupling the rotor to the roller. Further, the roller may define a recess having a bushing mounted therein, wherein the bushing defines a radially extending slot with the vane being disposed within the slot. Because the bushing is mounted on an eccentric roller, the bushing is slidable relative to the vane.

The roller and the vane may divide the compression chamber into a variable-volume suction pocket and a variable-volume compression pocket. The rotor and the roller may rotate and thereby compress working fluid in the compression pocket and draw working fluid into a the suction pocket.

The compressor may also include first and second end plates disposed at opposite axial ends of the compression chamber. At least one of the end plates may define a fluid passageway providing fluid communication between the internal passageway of the shaft and the compression chamber. The shaft extends through one or both of the end plates. The stator circumscribes the rotor, the compression chamber disposed therein and the first and second end plates.

One of the end plates disposed at an end of the compression chamber may have a discharge valve cavity in fluid communication with the compression chamber and a discharge valve member disposed within the discharge valve cavity and controlling fluid flow from the compression chamber through the discharge valve cavity.

The present invention comprises, in another form thereof, a rotary compressor for compressing a working fluid including a stationary shaft having a longitudinal passage with a lubricant inlet and a working fluid inlet to receive the working fluid. A motor has a stator and a rotor. The rotor is rotatably mounted on the shaft and includes an internal compression chamber. A roller is rotatably mounted on the shaft and within the compression chamber wherein the roller is rotatable about an axis spaced from a rotational axis of the rotor. The compression chamber is divided between the roller and the rotor into a variable-volume suction pocket and a variable-volume compression pocket. The compression pocket is at least periodically in fluid communication with a chamber containing a lubricant source wherein compressed working fluid is communicated to the chamber. The suction pocket is at least periodically in fluid communication with the longitudinal passage wherein working fluid is communicated from the longitudinal passage to the suction pocket. The roller is coupled to the rotor and is eccentrically mounted within the compression chamber such that rotation of the rotor shrinks the compression pocket and expands the suction pocket. The expansion of the suction pocket operates to draw the working fluid through the longitudinal passage and into the suction pocket. The shrinkage of the compression pocket operates to compress the working fluid within the compression pocket. Lubricant from the lubricant source is forced through the lubricant inlet and into the longitudinal passage due to a pressure differential created by the operation of the rotary compressor.

The present invention comprises, in yet another form thereof, a rotary compressor for compressing a working fluid including a housing having an interior chamber and an oil sump disposed within the interior chamber. A stationary shaft extends into the interior chamber and includes a longitudinal passage. The longitudinal passage has an oil inlet in fluid communication with the oil sump and a working fluid inlet to receive the working fluid. A motor includes a stator and a rotor. The rotor is rotatably mounted on the shaft within the interior chamber and has an internal compression chamber in at least periodic fluid communication with the longitudinal passage and in at least periodic fluid communication with the interior chamber. The rotor rotates and thereby draws the working fluid from the longitudinal passage into the compression chamber. The rotor rotation also increases pressure in the interior chamber such that oil from the oil sump enters the oil inlet and flows within the longitudinal passage in a substantially upward direction.

The invention comprises, in still another form thereof, a rotary compressor assembly that includes a motor having a rotor defining a substantially cylindrical compression chamber having an axis, a first plate and a second plate fixed relative to the rotor and defining opposite ends of the compression chamber and a stationary shaft extending axially through the compression chamber. A roller is rotatably mounted on the stationary shaft and disposed within the compression chamber. A vane is provided and has an outer radial end fixed to the rotor. The vane extends radially inwardly and is fixed to the first and second plates proximate a radial inner end of the vane. The roller defines a slot and the radial inner end of the vane is disposed within the slot wherein the vane and slot are relatively slidable. Rotation of the rotor rotates the first and second plates and the vane while rotation of the vane drivingly rotates the roller. A pin may be used to fix the vane to the first and second plates. The pin extends through the vane proximate the inner radial end of the vane and at least partially engages the first and second plates.

An advantage of the present invention is that oil can be provided to a bearing and other moving parts during operation. The oil can be supplied under pressure that is created by the compressor.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
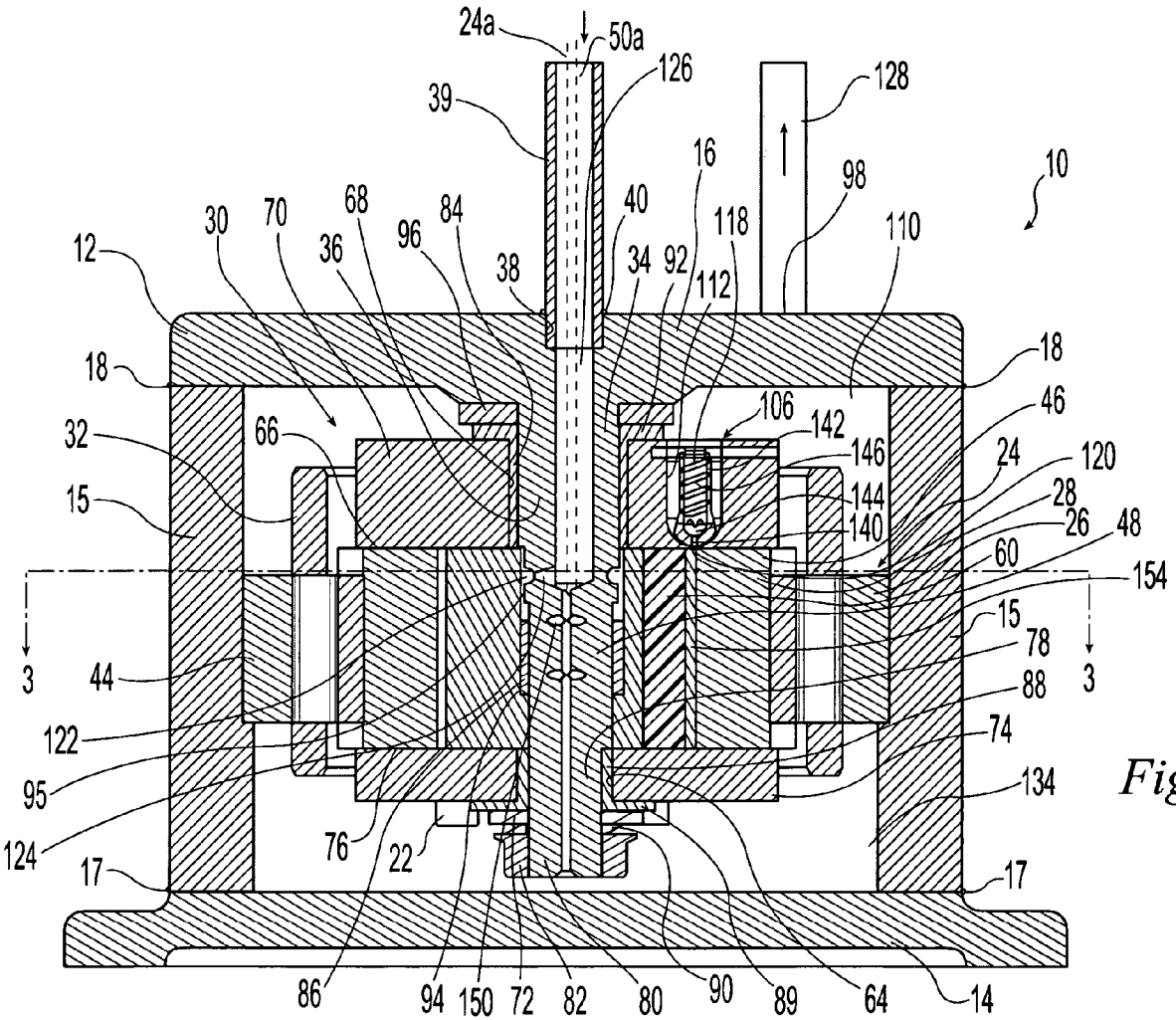
FIG. 1 is a side sectional view of a compact rotary compressor in accordance with the present invention.

Corresponding reference characters indicate corresponding parts throughout the several views. Although the exemplification set out herein illustrates an embodiment of the invention, in one form, the embodiment disclosed below is not intended to be exhaustive or to be construed as limiting the scope of the invention to the precise form disclosed.

DESCRIPTION OF THE PRESENT INVENTION

Figure 2:
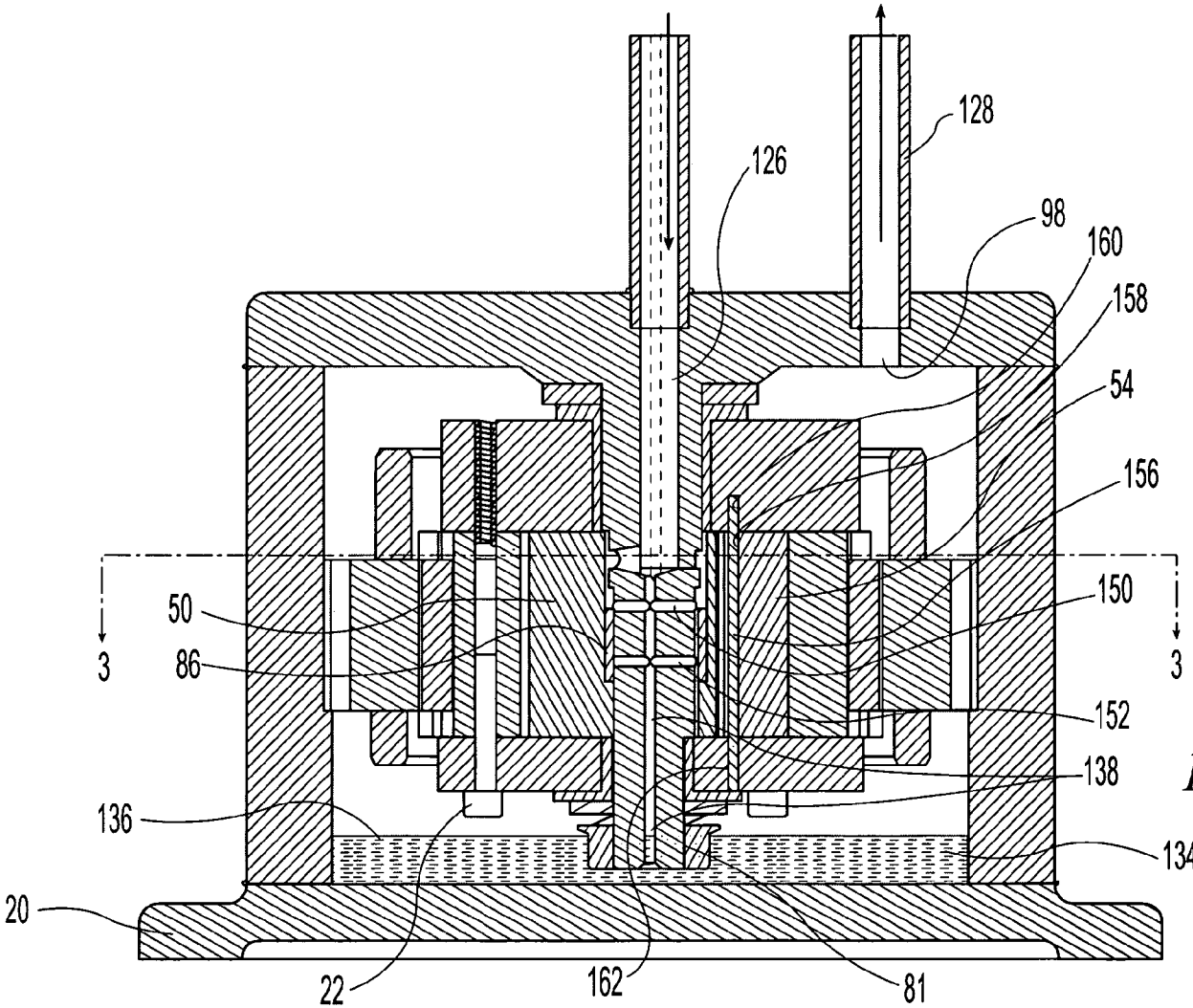
FIG. 2 is another side sectional view, from another angle, of the compressor of FIG. 1.

Referring now to the drawings and particularly to FIGS. 1 and 2, there is shown a compact rotary compressor 10. Compressor 10 has hermetically sealed housing 12 including base 14, annular side wall 15 and top wall 16. Base 14 is hermetically sealed to wall 15 by welding, brazing, or the like at location 17. Similarly, side wall 15 is hermetically sealed to top wall 16 by welding, brazing, or the like at location 18. The diameter of base 14 is greater than the diameter of annular side wall 15 to provide a flange 20 that may have throughholes (not shown) therein for mounting compressor 10.

Compressor 10 includes electric motor 24 having stator 26 and rotor 28 which defines a portion of compression mechanism 30 provided for compressing refrigerant, such as carbon dioxide, from a low pressure to a higher pressure for use in a refrigeration system, for example. Stator 26, having coil assembly 32, is rigidly mounted and circumscribes rotor 28. Extending through rotor 28 is stationary shaft 34 which can be integrally formed at upper end 36 with top wall 16. An aperture 38 may be centrally formed in top wall 16 for receiving a tube or fitting 39 that can be fixedly attached to top wall 16 by welding, brazing, or the like. Suction pressure refrigerant can enter longitudinal passage 126 via fitting 39. In the illustrated embodiment, weld 40 secures fitting 39 to top wall 16.

Figure 3:
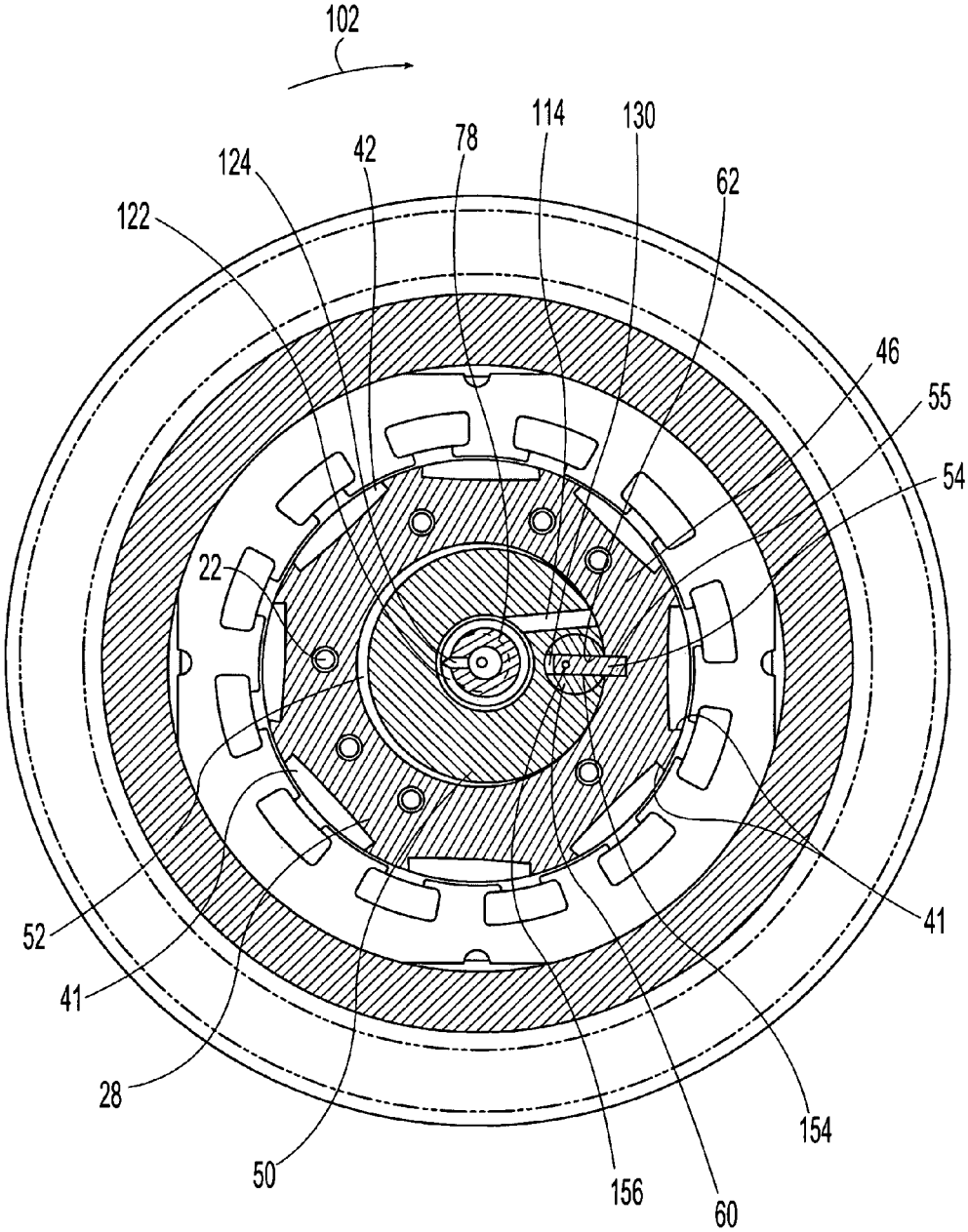
FIG. 3 is a top sectional view of the compressor of FIG. 1 along line 3—3 showing a first position.
Figure 4:
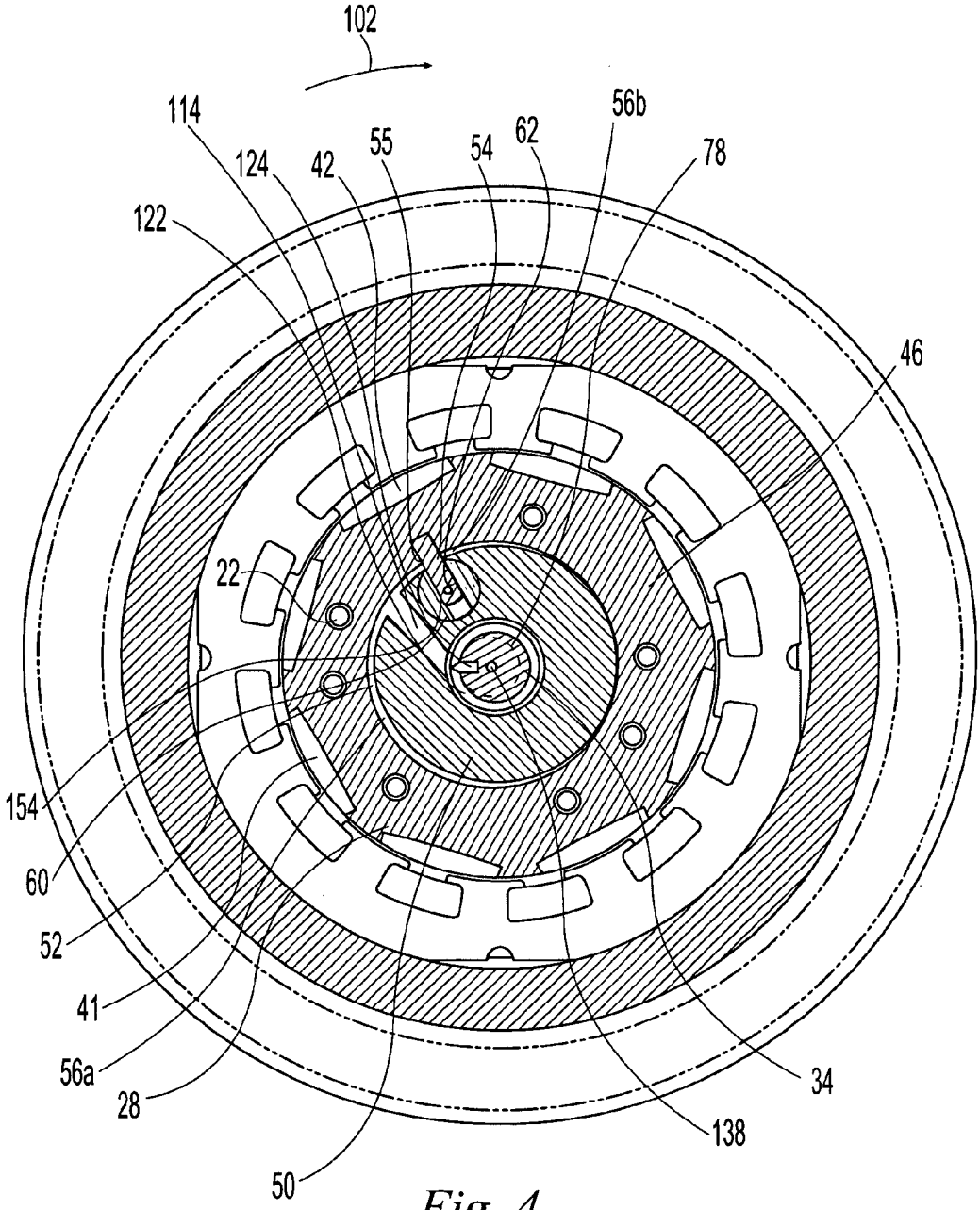
FIG. 4 is a top sectional view of the compressor of FIG. 1 showing a second position.

Referring to FIGS. 3 and 4, a plurality of pockets 41 are formed in the outer circumferential surface of rotor 28 in which permanent magnets 42, such as neodymium iron boron magnets, are mounted by any suitable method including the use of adhesives, for example. Rotor 28 is circumscribed by lamination stack 44 of stator 26 (FIG. 1) and, during operation of compressor 10, stator 26 generates a rotating electromagnetic field to rotationally drive rotor 28 having permanent magnets 42 mounted thereon. Rotor 28 also defines an internal compression chamber 52. In the illustrated embodiment, rotor 28 is integrally formed from a solid metal material such as steel, powder metal, ductile iron, or the like in the general shape of an annular ring. The rotor may be manufactured using any suitable method including electric discharge machining (EDM). By using a solid integral part to form rotor 28, no lining is required for internal compression chamber 52. A vane 54 extends radially inwardly within compression chamber 52 to engage roller 50 as discussed in greater detail below.

Stationary shaft 34 and integral top wall 16 can be formed from any suitable metal material including steel, powder metal, ductile iron, or the like by any conventional method including machining, for example. Referring to FIG. 1, an eccentric portion 48 is integrally formed on shaft 34 and is located within compression chamber 52 defined by rotor 28. Roller 50 forms a part of compression mechanism 30 and is rotatably mounted on eccentric 48. Referring to FIGS. 3 and 4, vane 54 is snugly received in a slot 55 that can be machined in the inner surface of rotor 28 that defines compression chamber 52. Alternatively, vane 54 can be integrally formed with rotor 28. Vane 54 extends radially inwardly from the inner surface of rotor 28 and engages roller 50. Vane 54, together with roller 50 divides compression chamber 52 into a variable-volume, crescent-shaped suction pocket 56*a* and a variable-volume, crescent-shaped compression pocket 56*b*.

Figure 7:
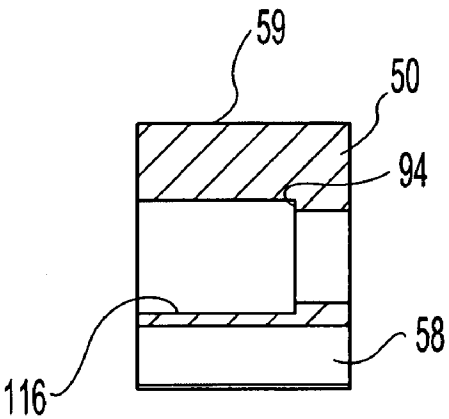
FIG. 7 is sectional view of the roller along line 7—7 in FIG. 6.
Figure 6:
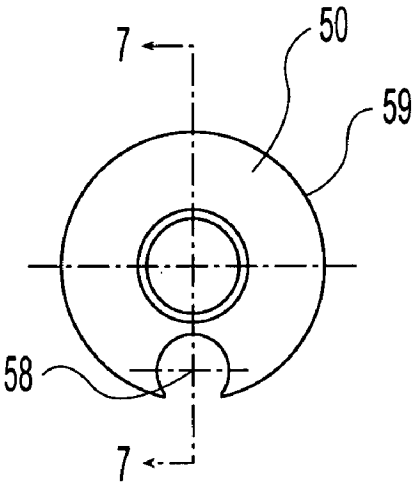
FIG. 6 is a top view of the roller of FIG. 5.
Figure 5:
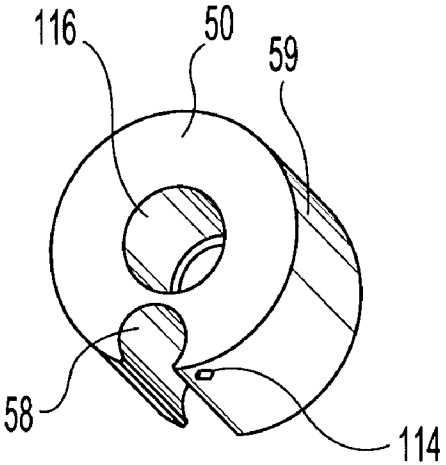
FIG. 5 is a perspective view of the roller of the compressor of FIG. 1.

Referring to FIGS. 3 and 4, in order to allow for the relative sliding movement between vane 54 which extends radially inwardly from cylinder block portion 46 of rotor 28 and roller 50, roller 50 is provided with cylindrical aperture 58, as best seen in FIGS. 5, 6 and 7. Aperture 58 extends longitudinally through roller 50 adjacent the outer periphery thereof and defines an opening in an outer circumferential surface 59 of roller 50. Guide bushing 60 is mounted in aperture 58 and has a longitudinally extending slot 62 formed therein to slidably receive vane 54 such that as rotor 28 together with fixed vane 54 and roller 50 rotate, the surfaces of the bushing 60 facing vane 54 slide along vane 54 due to the roller/rotor eccentricity and roller 50 moves toward and away from the compression chamber wall adjacent vane 54. Bushing 60 also oscillates within aperture 58 to allow for change in angular position of vane 54 with respect to aperture 58 as rotor 24 and roller 50 are rotated. Similarly, aperture 58 has a radially outer opening that provides a sufficiently large operating clearance to allow for this relative angular movement of vane 54 during operation of the compressor. In the illustrated embodiment, bushing 60 is a two-piece bushing, however, alternative embodiments may employ a single piece bushing wherein an interconnecting web of material extends between the two halves of the bushing through a portion of space 130 and is sufficiently thin to avoid interfering with the inner radial end of vane 54 and the reciprocation of vane 54 within slot 62.

Guide bushing 60 can be made from a material with suitable antifriction properties. In the illustrated embodiment, bushing 60 is formed using Vespel SP-21, a material commercially available from E.I. du Pont de Nemours and Company, and which facilitates the reduction of frictional losses caused by sliding movement of vane 54 relative to slot 62 and relative oscillating movement of bushing 60 within aperture 58 of roller 50. The use of a guide bushing 60 from a material with good antifriction properties facilitates the reduction of wear of the surfaces of roller 50, vane 54, and guide bushing 60 that are in moving contact to thereby improve the longevity and reliability of the compressor.

As discussed above, and in more detail below, vane 54 can be snugly fixed within slot 55 or perhaps integrally formed with the cylinder block portion 46 of rotor 28 such that vane 54 does not move relative to rotor 28. The use of bushing 60 together with such a fixed vane eliminates the need for a vane spring to press the vane against the roller. The use of bushing 60 to slidably receive vane 54, instead of a spring biased vane, may also reduce the frictional losses created by the vane during operation of the compressor. The relatively minimal frictional losses caused by vane 54 facilitates the minimization of power losses due to friction. The use of a fixed vane that is slidably received within bushing 60 also facilitates the reduction of refrigerant vapor leakage across the barrier formed by vane 54 between a relatively high pressure compression pocket 56*b* to a relatively low pressure suction pocket 56*a* during operation of the compressor. The reduced frictional losses and refrigerant leakage facilitate the efficient and reliable operation of the compressor.

Referring to FIG. 1, compression mechanism 30 also includes a disk-shaped top end plate 70 located in adjacent contact with upper axial end surface 66 of rotor 28 to partially define and seal compression chamber 52. Top plate 70 is provided with central aperture 68 through which shaft 34 extends. A disk-shaped bottom end plate 74 is positioned in adjacent contact with the lower axial end surface 76 of rotor 28 and partially defines and seals compression chamber 52. Bottom plate 74 is provided with central aperture 64 through which a lower, non-eccentric portion 78 of shaft 34 extends. Non-eccentric portion 78 has a smaller diameter than eccentric portion 48, which has a smaller diameter than upper portion 36. Bottom end plate 74 is rotatably mounted on stationary shaft 34 via a sleeve-like self-lubricated bearing 88 that is received in aperture 64. A metal washer 72 may be provided, bearing against a polyamide thrust member 89. Similarly, on the opposite end of shaft 34, a metal washer 96 may bear against a polyamide thrust member 92. In order to anchor compression mechanism 30 in adjusted position on shaft 34, a distal tip 80 of non-eccentric portion 78 may be threaded, as indicated by dashed lines 81 in FIG. 8, to receive a holding nut 82. A spring washer 90 can be used as a preload spring for thrust surfaces 89, 92 and to improve axial positioning of compression mechanism 30 on shaft 34 with limited or no axial play.

Upper end plate 70, rotor 28 and lower plate 74 can be secured together to define compression chamber 52. In the illustrated embodiment, a plurality of bolts 22 extend through apertures in upper end plate 70, rotor 28, and lower end plate 74 to secure these components to one another. Alternative embodiments may employ alternative methods of securing these components together such as welding.

Compression assembly 30 can be rotatably mounted on shaft 34 by flanged, self-lubricated bearings 84, 88 and a needle roller and cage radial assembly bearing 86 which are press-fit into the apertures defined by upper end plate 70, lower end plate 74, and the inner diameter of roller 50, respectively. Bearing 86 can be axially guided by a shoulder 94 machined at one end in roller 50 and a shaft shoulder 95 on the other (upper) end of bearing 86. In one embodiment, the height of bearing 86 may be approximately between 70% and 90% of the diameter of bearing 86 in order to provide improved axial guidance. When the compressor is operating and rotor 28 is rotated, bearings 84, 86, and 88 rotatably support compression assembly 30 as it is rotatably driven about stationary shaft 34.

As best seen in FIG. 1, bearings 84 and 88 which rotatably support rotor 28 and the first and second end plates enclosing compression chamber 52 are centered on rotor axis 24*a*, and bearing 86 rotatably supporting roller 50 is centered on roller axis 50*a* defined by eccentric portion 48 of shaft 34. Axes 24*a* and 50*a* are spaced apart whereby roller 50 forms a line, or area, of contact with the inner surface of rotor 28 that defines compression chamber 52. The line or area of contact is fixed relative to shaft 34, but progressively travels along the circumference of the inner surface of rotor 28 as rotor 28 and roller 50 rotate in a clockwise direction indicated by arrow 102 about their respective axes. The relative rotation of rotor 28 and compression chamber 52 and roller 50 with respect to shaft 34 and axes 24*a* and 50*a* defines suction pocket 56*a* (FIG. 4) for drawing refrigerant into compression chamber 52 which then becomes a compression pocket 56*b* for compressing refrigerant therein as rotor 28 continues to rotate.

Bearings 84, 86, 88 and thrust members 89, 92 may be formed from a polyamide material having relatively low coefficients of static and kinetic friction such as Vespel SP-21. Another beneficial characteristic associated with polyamide is that it demonstrates thermal stability over a relatively broad temperature range. For example, polyamide bushings may be capable of withstanding a bearing pressure of approximately 300,000 lb ft/in$^2$ and a contact temperature of 740° F. For improved performance of the bushings and to avoid overheating, bushings 84, 86 and 88 advantageously may have a length-to-inside diameter ratio of equal to or less than 3:2.

Compressor 10 as described above utilizes a bushing 60 and bearings 84 and 88 that may potentially operate without lubrication. However, as discussed in more detail below, compressor 10 includes an oil sump from which lubricating oil is delivered to bearing 86 which may be in the form of a needle or ball-type bearing that requires lubrication. Lubricating oil may also be provided to bearing 88 and bushing 60 from the oil sump.

Figure 8:
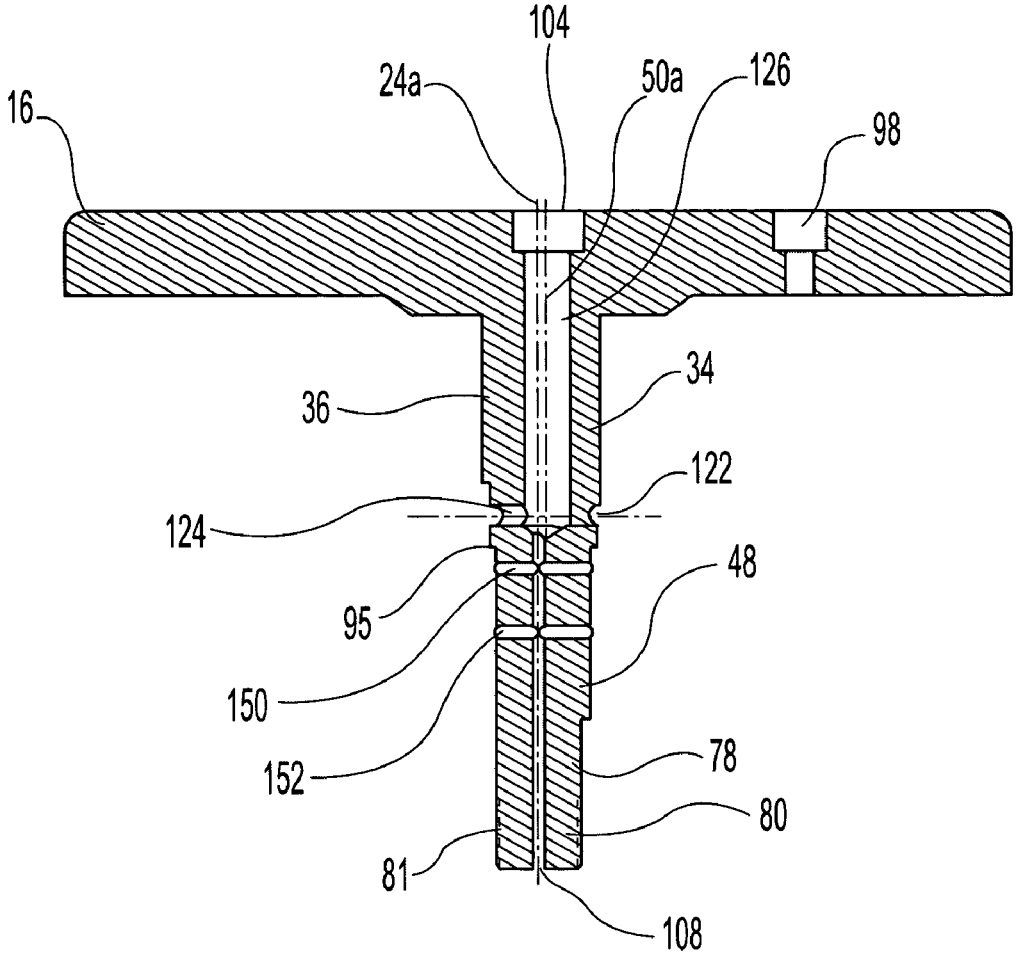
FIG. 8 is a side sectional view of the stationary shaft of the compressor of FIG. 1.

In the illustrated embodiment, shaft 34 includes a longitudinal passage 126 having a refrigerant inlet 104, best shown in FIG. 8, at an upper end of shaft 34 and an oil inlet 108 at a lower end of shaft 34. Longitudinal passage 126 is in fluid communication with compression chamber 52 via a radially-oriented passage or channel 124 and a through channel 114 in roller 50. Channel 114 extends between an annular inner surface 116 (FIG. 5) of roller 50 and outer surface 59. An annular groove 122 is disposed at the outermost end of radial passage 124 on shaft 34. Once the refrigerant gas is compressed to a higher pressure within compression pocket 56*b*, the compressed gas is discharged through a discharge passage 120 (FIG. 1) and an integral discharge valve 118 into an interior chamber 110 of housing 12. Also located in housing 12 is outlet 98 through which high pressure refrigerant can exit interior chamber 110.

Thus, compressor 10 is a high side compressor in which interior chamber 110 is filled with discharge pressure refrigerant. The compressed refrigerant is at a higher temperature than the suction pressure refrigerant in passage 126, and housing 12 can facilitate the cooling of the compressed refrigerant by absorbing heat therefrom. The present invention is not limited to high side compressors, however, and alternative embodiments may employ a variety of configurations including compressor designs wherein the interior chamber of the housing is at least partially filled with suction pressure refrigerant.

At the bottom of interior chamber 110 may be provided an oil sump 134 for containing a pool of a lubricant such as oil. In the embodiment shown in FIG. 2, a top surface 136 of the oil within interior chamber 110 is shown to be at approximately the same vertical level as spring washer 90. Passages 124, 150 and 152 all open to the space located between stationary shaft 34 and roller 50 which is, therefore, at suction pressure. The pressure differential between the high pressure refrigerant within interior chamber 110 and the suction pressure refrigerant within longitudinal passage 126 and between stationary shaft 34 and roller 50 causes oil from sump 134 to flow upwardly through oil inlet 108 within reduced diameter portion 138 of longitudinal passage 126. Portion 138 can extend approximately between radial passage 124 and oil inlet 108. In fluid communication with narrow portion 138 are radially oriented oil supply passages or channels 150, 152 which can be at approximately the vertical level of bearing 86. Passages 150, 152 allow oil from narrow portion 138 to reach and lubricate bearing 86.

A portion of the lubricant oil may also flow far enough in an upward direction to exit longitudinal passage 126 through radial passage 124. Further, a portion of the oil entrained in the suction pressure refrigerant will continue on through channel 114, compression chamber 52 and discharge valve 118 before returning to interior chamber 110 where it migrates downwardly to the oil sump. Thus, the oil may lubricate rotor 28, roller 50, sides 154 of vane 54, bushing 60, slot 62, and discharge valve 118.

Assembly of compressor 10 may advantageously include first assembling compression assembly 30. Initially, vane 54 is placed in slot 55 of rotor 28, and vane 54 is secured to top end plate 70 by a pin 156 (FIGS. 2 and 3) that is inserted through a throughhole 158 in vane 54 and into a recess 160 in plate 70. Next, roller 50, having guide bushing 60 press fit therein, is located in compression space 52 such that vane 54 engages slot 62 and rotor 28 is positioned in abutting contact with top end plate 70. The exposed end of pin 156 at the opposite end of rotor 28 is then aligned with and inserted into a recess 162 in bottom end plate 74. Bottom end plate 74 can then be secured to rotor 28 by bolts 22 inserted into throughholes in end plates 70, 74 and rotor 28.

Thus, the outer radial end of vane 54 is fixed to rotor 28 and the inner radial end of vane 54 is also fixed by pin 156 which extends through vane 54 into both end plates 70, 74. By fixing both ends of vane 54, instead of having only the outer radial end of vane 54 fixed to rotor 28, the stresses within vane 54 are significantly reduced thereby reducing the possibility of failure of the compressor due to the breakage of vane 54. The reduction in stress in vane 54 and the fixing of both ends of vane 54 also help to minimize the deflection of vane 54 due to the forces applied to vane 54 by its driving of the rotation of roller 50. Minimizing the deflection of vane 54 facilitates the non-binding sliding of bushing 60 relative to vane 54. Although only one vane 54 is used in the illustrated embodiment, alternative embodiments of the present invention may employ multiple vanes to further subdivide the compression chamber into working pockets.

The following components can be successively press fit or otherwise placed on shaft 34: metal washer 96, bearing 84, bearing 86, compression assembly 30, bearing 88, metal washer 72, and spring washer 90. With distal tip 80 of shaft 34 extending through aperture 64, the foregoing components can then be secured to shaft 34 by threadingly coupling holding nut 82 to distal tip 80. Thus, compression assembly 30 is rotatably mounted on shaft 34. Side wall 15 with stator 26 shrink fitted or otherwise attached thereto can be bonded to top wall 16 via a weld at location 18. Base 14 can be bonded to side wall 15, in turn, via a weld at location 17.

Compression mechanism 30 is positioned within housing body portion 16 such that rotor 28 is aligned with stator 26. By positioning compression chamber 52 within rotor 28 and circumscribing rotor 28, compression chamber 52 and end plates 70 and 74 with stator 26, the overall assembled axial extending length of compressor 10 is relatively limited and thereby provides a compact overall design that facilitates the flexible positioning of the compressor. The compact arrangement provided by the present invention can allow the axial length of the compressor to be reduced to approximately the same axial length as of the stator 26.

During compressor operation, electrical current supplied to stator 26 via a terminal assembly (not shown) creates a magnetic flux which in turn causes rotation of rotor 28. The rotation of rotor 28 drives the rotation of roller 50 about drive shaft 34 through vane 54 which is fixed relative to rotor 28 and is slidingly disposed relative to roller 50. Referring to FIGS. 3 and 4, as rotor 28 and roller 50 rotate, vane 54 slides relative to slot 62 in bushing 60, the semi-crescent-shaped suction pocket 56*a* defined within compression chamber 52 becomes progressively larger, and the semi-crescent-shaped compression pocket 56*b* defined within compression chamber 52 become progressively smaller, i.e., shrinks. As pocket 56*a* expands, refrigerant and oil is drawn into pocket 56*a* through channel 114. As pocket 56*b* decreases in volume, the high-pressure mixture of refrigerant and oil is expelled through discharge passage 120 once the pressure within compression pocket 56*b* is sufficient to open discharge valve assembly 106.

Channel 114 is in communication with suction pocket 56*a* and discharge passage 120 is in communication with compression pocket 56*b* throughout an entire 360 degree rotation of rotor 28 and roller 50 about shaft 34. After refrigerant is drawn into a suction pocket 56*a*, rotation of rotor 28 and roller 50 about shaft 34 causes suction pocket 56*a* to reach its maximum volume, as shown in FIG. 3. At this point, compression pocket 56*b* has been fully compressed to zero volume, and the refrigerant has been expelled through discharge passage 120. Further rotation of rotor 28 and roller 50 from the point shown in FIG. 3 begins the compression of the refrigerant, and transforms what was a suction pocket 56*a* into a compression pocket 56*b*. The further rotation of rotor 28 and roller 50 also simultaneously begins expansion of a new suction pocket 56*a*, as can be best seen by comparing FIGS. 3 and 4. The progressive reduction in size of the compression pocket and the compression of the refrigerant vapor disposed therein, with the compression pocket being in fluid communication with discharge valve assembly 106, causes the pressure within the compression pocket to open the discharge valve assembly 106. Compressed refrigerant is discharged from compression chamber 52 through discharge passage 120 and the discharge valve assembly 106 disposed within discharge valve cavity 112 formed in plate 70, as best seen with reference to FIG. 1.

The discharge valve assembly includes a valve seat body 142 defining a discharge port 140 in fluid communication with compression chamber 52 via discharge passage 120. The discharge valve assembly also includes a spherical valve member 144 biased into engagement with a valve seat defined by body 142 by spring 146 to thereby seal the discharge port. A retaining ring not shown) can be used to secure spring 146 within valve seat body 142. When the fluid pressure within discharge pocket 56*b* exceeds the pressure necessary to overcome the biasing force of spring 146, the valve will be forced open and refrigerant will be discharged from compression chamber 52 through discharge port 140. The discharged refrigerant is then communicated through discharge cavity 112 to interior chamber 110. The compressed refrigerant is discharged from compressor 10 through discharge fitting 128 to a system that utilizes compressed fluid such as a refrigeration system or heat pump system.

As described above, compression pocket 56*b* is in fluid communication with interior chamber 110 and oil sump 134 whenever the valve is open. Since the valve opens periodically, following the cyclical increase in pressure in a compression pocket 56*b*, compression pocket 56*b* is periodically in fluid communication with interior chamber 110 and oil sump 134.

In the embodiments described above, suction pocket 56*a* is continuously in fluid communication with longitudinal passage 126. However, it may also be possible in other embodiments for suction pocket 56*a* to be periodically in fluid communication with longitudinal passage 126 via a one-way check valve. Such a check valve could be disposed within channel 114, for example.

The compressor of the present invention has been described herein as rotating in a clockwise direction, i.e., in direction 102 shown in FIG. 3. However, it is to be understood that the motor can also be arranged such that the compressor rotates in a counterclockwise direction, i.e., opposite to direction 102. With such a counterclockwise rotation, channel 114 may be disposed on a side of the vane opposite to that shown in FIGS. 3 and 4. That is, regardless of the direction of rotation, the vane may lead the channel in rotation. Further, regardless of the direction of rotation, discharge valve 118 may lead both the vane and the channel in rotation. Thus, regardless of the direction of rotation, the discharge valve may be in fluid communication with a compression pocket, and the channel may be in fluid communication with a suction pocket.

While this invention has been described as having an exemplary design, the present invention may be further modified within the spirit and scope of this disclosure. This application is therefore intended to cover any variations, uses, or adaptations of the invention using its general principles.

What is claimed is:

1. A rotary compressor for compressing a working fluid comprising:

a housing including an oil sump;

a stationary shaft extending into said housing and including a longitudinal passage, said longitudinal passage having:

an oil inlet in fluid communication with said oil sump; and a working fluid inlet configured to receive the working fluid;

a motor having a stator and a rotor, said rotor being rotatably mounted on said shaft within said housing and including an internal compression chamber in fluid communication with said longitudinal passage; and a roller rotatably mounted on said shaft and eccentrically disposed within said compression chamber, said roller being coupled to said rotor wherein rotation of said rotor compresses the working fluid within said compression chamber.

2. The rotary compressor of claim 1 wherein said housing includes an interior chamber, said oil sump being disposed in said interior chamber, working fluid compressed within said compression chamber being discharged into said interior chamber wherein oil from said oil sump enters said oil inlet and flow within said longitudinal passage in a substantially upward direction due to a pressure differential created by said compressed working fluid within said interior chamber.

3. The rotary compressor of claim 2 wherein said shaft includes at least one substantially radially-oriented passage providing fluid communication between said longitudinal passage and said compression chamber.

4. The rotary compressor of claim 3 wherein at least a portion of the oil and a portion of the working fluid exits said longitudinal passage through a same said radially-oriented passage.

5. The rotary compressor of claim 3 further comprising a bearing disposed between said shaft and said roller, said at least one substantially radially-oriented passage being positioned wherein oil from said longitudinal passage reaches said bearing.

6. The rotary compressor of claim 2 wherein said housing includes an outlet communicating compressed working fluid from said interior chamber outwardly through said housing.

7. The rotary compressor of claim 1 wherein said roller includes a channel providing fluid communication between said longitudinal passage and said compression chamber.

8. The rotary compressor of claim 1 wherein said rotor is integrally formed.

9. The rotary compressor of claim 1 wherein said rotor includes a radially outer surface having a plurality of permanent magnets mounted thereon.

10. The rotary compressor of claim 1 wherein said rotor includes a vane extending radially inwardly within said compression chamber and coupling said rotor to said roller.

11. The rotary compressor of claim 10 wherein said roller defines a recess having a bushing mounted therein, said bushing defining a radially extending slot, said vane being disposed within said slot wherein said slot and said vane are relatively slidable.

12. The rotary compressor of claim 10 wherein said roller and said vane divide said compression chamber into a variable-volume suction pocket and a variable-volume compression pocket, said rotor and said roller being configured to rotate and thereby compress working fluid in said compression pocket and draw working fluid into said suction pocket.

13. The rotary compressor of claim 1 further comprising first and second end plates disposed at opposite axial ends of said compression chamber, said shaft extending through at least one of said end plates.

14. The rotary compressor of claim 13 wherein said housing includes an interior chamber, said oil sump being disposed in said interior chamber, at least one of said end plates including a fluid passageway providing fluid communication between said compression chamber and said interior chamber.

15. The rotary compressor of claim 13 wherein said shaft extends through both said first end plate and said second end plate.

16. The rotary compressor of claim 1 further comprising at least one end plate disposed at an end of said compression chamber, said at least one end plate having a discharge valve cavity in fluid communication with said compression chamber, said at least one end plate including a discharge valve member disposed within said discharge valve cavity and controlling fluid flow from said compression chamber through said discharge valve cavity.

17. A rotary compressor for compressing a working fluid comprising:

a stationary shaft including a longitudinal passage having a lubricant inlet and a working fluid inlet configured to receive the working fluid;

a motor having a stator and a rotor, said rotor being rotatably mounted on said shaft and including an internal compression chamber; and a roller rotatably mounted on said shaft and within said compression chamber wherein said roller is rotatable about an axis spaced from a rotational axis of said rotor, said compression chamber being divided between said roller and said rotor into a variable-volume suction pocket and a variable-volume compression pocket, said compression pocket being at least periodically in fluid communication with a chamber containing a lubricant source wherein compressed working fluid is communicated to said chamber containing said lubricant source, said suction pocket being at least periodically in fluid communication with said longitudinal passage wherein working fluid is communicated from said longitudinal passage to said suction pocket, said roller being coupled to said rotor such that rotation of said rotor shrinks said compression pocket and expands said suction pocket, said expansion of said suction pocket operating to draw the working fluid through said longitudinal passage and into said suction pocket, said shrinkage of said compression pocket operating to compress the working fluid within said compression pocket and wherein lubricant from said lubricant source is forced through said lubricant inlet and into said longitudinal passage due to a pressure differential created by operation of said rotary compressor.

18. The rotary compressor of claim 17 wherein said shaft includes at least one substantially radially-oriented passage providing fluid communication between said longitudinal passage and said compression chamber.

19. The rotary compressor of claim 18 wherein at least a portion of the lubricant and a portion of the working fluid exits said longitudinal passage through a same said radially-oriented passage.

20. The rotary compressor of claim 19 further comprising a bearing disposed between said shaft and said roller, said at least one substantially radially-oriented passage being positioned wherein lubricant from said longitudinal passage reaches said bearing.

21. The rotary compressor of claim 17 wherein said roller includes a channel providing fluid communication between said longitudinal passage and said suction pocket.

22. The rotary compressor of claim 17 wherein said rotor is a non-laminated integrally formed part.

23. The rotary compressor of claim 17 wherein said rotor includes a radially outer surface having a plurality of permanent magnets mounted thereon.

24. The rotary compressor of claim 17 wherein said rotor includes a vane extending radially inwardly within said compression chamber and coupling said rotor to said roller.

25. The rotary compressor of claim 24 wherein said roller defines a recess having a bushing mounted therein, said bushing defining a radially extending slot, said vane being disposed within said slot wherein said slot and said vane are relatively slidable.

26. The rotary compressor of claim 17 further comprising first and second end plates disposed at opposite axial ends of said compression chamber, said shaft extending through at least one of said end plates.

27. The rotary compressor of claim 26 further comprising a housing including an interior chamber, said shaft and said motor being disposed in said interior chamber, said lubricant source comprising a lubricant sump disposed in said interior chamber.

28. The rotary compressor of claim 27 wherein said housing includes an outlet communicating compressed working fluid from said interior chamber outwardly through said housing.

29. The rotary compressor of claim 27 wherein at least one of said end plates includes a fluid passageway providing fluid communication between said compression pocket and said interior chamber.

30. The rotary compressor of claim 27 wherein said stationary shaft is integrally formed with a top portion of said housing.

31. The rotary compressor of claim 26 wherein said shaft extends through both said first end plate and said second end plate.

32. The rotary compressor of claim 17 further comprising at least one end plate disposed at an end of said compression chamber, said at least one end plate having a discharge valve cavity in fluid communication with said compression pocket, said at least one end plate including a discharge valve member disposed within said discharge valve cavity and controlling fluid flow from said compression pocket through said discharge valve cavity.

33. A rotary compressor for compressing a working fluid comprising:

a housing including an interior chamber and an oil sump disposed within said interior chamber;

a stationary shaft extending into said interior chamber and including a longitudinal passage, said longitudinal passage having an oil inlet in fluid communication with said oil sump and a working fluid inlet configured to receive the working fluid; and a motor including a stator and a rotor, said rotor being rotatably mounted on said shaft within said interior chamber and disposed directly adjacent said stator, said rotor having an inner surface that forms an internal compression chamber in at least periodic fluid communication with said longitudinal passage and in at least periodic fluid communication with said interior chamber, said rotor being configured to rotate and to thereby:

draw the working fluid from the longitudinal passage into said compression chamber; and increase pressure in said interior chamber such that oil from said oil sump enters said oil inlet and flows within said longitudinal passage in a substantially upward direction.

34. A rotary compressor assembly comprising:

a motor having a stator and a rotor disposed directly adjacent said stator, said rotor having an inner surface that forms a substantially cylindrical compression chamber having an axis;

a first plate and a second plate fixed relative to said rotor and defining opposite ends of said compression chamber;

stationary shaft extending axially through said compression chamber;

a roller rotatably mounted on said stationary shaft and disposed within said compression chamber;

a vane having an outer radial end fixed to said rotor and extending radially inwardly, said vane being fixed to said first and second plates proximate a radial inner end of said vane; and wherein said roller defines a slot, said radial inner end of said vane being disposed within said slot, rotation of said rotor rotating said first and second plates and said vane, rotation of said vane drivingly rotating said roller, said vane and said roller being relatively slidable.

35. The rotary compressor assembly of claim 34 further comprising a pin extending through an aperture in said vane proximate said inner radial end of said vane, said pin at least partially engaging said first and second plates wherein said pin fixes said vane to said first and second plates.

* * * * *

UNITED STATES PATENT AND TRADEMARK OFFICE

CERTIFICATE OF CORRECTION

PATENT NO. : 7,217,110 B2
APPLICATION NO. : 10/796711
DATED : May 15, 2007
INVENTOR(S) : Nelik I. Dreiman It is certified that error appears in the above-identified patent and that said Letters Patent is hereby corrected as shown below:

Claim 2, Column 10, line 40 delete “flow” and insert --flows--

Claim 34, Column 14, line 4, before “stationary” insert --a--

Signed and Sealed this

Eighteenth Day of September, 2007

JON W. DUDAS
*Director of the United States Patent and Trademark Office*